US010012181B2

(12) United States Patent
Makino

(10) Patent No.: US 10,012,181 B2
(45) Date of Patent: Jul. 3, 2018

(54) FUEL VAPOR PROCESSING APPARATUS

(71) Applicant: AISAN KOGYO KABUSHIKI KAISHA, Obu-shi, Aichi-ken (JP)

(72) Inventor: Katsuhiko Makino, Aichi-ken (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 79 days.

(21) Appl. No.: 14/924,007

(22) Filed: Oct. 27, 2015

(65) Prior Publication Data

US 2016/0131052 A1 May 12, 2016

(30) Foreign Application Priority Data

Nov. 7, 2014 (JP) ..... 2014-226875

(51) Int. Cl.
*F02M 25/08* (2006.01)
*F02D 41/00* (2006.01)

(52) U.S. Cl.
CPC ..... *F02M 25/0854* (2013.01); *F02D 41/0032* (2013.01); *F02M 25/089* (2013.01); *F02M 25/0836* (2013.01); *F02D 41/0045* (2013.01); *F02D 2200/0625* (2013.01)

(58) Field of Classification Search
CPC ..... F02D 41/004; F02D 41/0032; F02D 41/0042; F02D 41/0045; F02D 41/003; F02D 19/027; F02D 19/0628; F02M 25/0836; F02M 25/0854; F02M 25/089; F02M 2025/0845
See application file for complete search history.

(56) References Cited

U.S. PATENT DOCUMENTS 5,669,360 A * 9/1997 Hyodo ..... F02M 25/0854 123/198 D
6,014,958 A * 1/2000 Miwa ..... F02D 41/0032 123/516
6,082,338 A * 7/2000 Izutani ..... F02D 13/0234 123/520

(Continued)

FOREIGN PATENT DOCUMENTS

CN 101503982 A 8/2009
JP 2001-206082 A 7/2001

(Continued)

OTHER PUBLICATIONS

Japanese Office Action dated Dec. 18, 2017, for Japanese Application No. 2014-226875 (4 p.).

(Continued)

*Primary Examiner* — Lindsay Low
*Assistant Examiner* — George Jin
(74) *Attorney, Agent, or Firm* — Conley Rose, P.C.

(57) ABSTRACT

A fuel vapor processing apparatus may include a canister and a purge device. The purge device may desorb fuel vapor from the canister and purge the desorbed fuel vapor to an engine. The fuel vapor processing apparatus may further include a purge control device. The purge control device may obtain a target purge quantity to be desorbed from the canister at a point of time during an operation of the engine. In addition, the purge control device may control a purge quantity during the operation of the engine such that the purge quantity reaches the target purge quantity.

10 Claims, 5 Drawing Sheets

(56) References Cited

U.S. PATENT DOCUMENTS

| | | | | |
|---|---|---|---|---|
| 6,354,281 | B1 * | 3/2002 | Mitsutani | F02M 25/08 123/520 |
| 7,717,095 | B2 | 5/2010 | Liu | |
| 2002/0129797 | A1 * | 9/2002 | Hayashi | F02D 41/0032 123/520 |
| 2009/0138173 | A1 * | 5/2009 | Liu | F02D 41/0032 701/103 |
| 2011/0166765 | A1 * | 7/2011 | DeBastos | B60K 15/03504 701/102 |
| 2012/0222657 | A1 * | 9/2012 | Sano | F02M 25/089 123/520 |

FOREIGN PATENT DOCUMENTS

| | | | |
|---|---|---|---|
| JP | 2002-332921 | A | 11/2002 |
| JP | 2007-198267 | A | 8/2007 |
| JP | 2008-240641 | A | 10/2008 |
| JP | 2009279992 | A | 12/2009 |
| JP | 2010095191 | A | 4/2010 |

OTHER PUBLICATIONS

English Translation of Japanese Office Action dated Dec. 18, 2017, for Japanese Application No. 2014-226875 (4 p.).
Chinese Office Action dated Sep. 14, 2017, for Chinese Application No. 201510751951.7 (3 p.)
English Translation of Chinese Office Action dated Sep. 14, 2017, for Chinese Application No. 201510751951.7 (5 p.)

* cited by examiner

FUEL VAPOR PROCESSING APPARATUS

CROSS-REFERENCE TO RELATED APPLICATIONS

This application is based upon and claims priority to Japanese Patent Application Serial No. 2014-226875 filed on Nov. 7, 2014, the contents of which are incorporated herein by reference in their entirety for all purposes.

STATEMENT REGARDING FEDERALLY SPONSORED RESEARCH OR DEVELOPMENT

Not applicable.

BACKGROUND

This disclosure generally relates to a fuel vapor processing apparatus that may include a canister for adsorbing fuel vapor produced in a fuel tank. The fuel vapor adsorbed by the canister may be desorbed and purged to an engine.

A known fuel vapor processing apparatus including a canister for adsorbing fuel vapor produced in a fuel tank is typically configured such that the canister adsorbs the fuel vapor during refueling to the fuel tank. Therefore, it may be optimal if the canister adsorbs the entirety of the fuel vapor produced during refueling. Japanese Laid-Open Patent Publication No. 2002-332921 discloses a fuel vapor processing apparatus in which the concentration of fuel vapor contained in a purge passage is detected for controlling a purge operation such that the detected concentration does not exceed a predetermined value.

In the fuel vapor processing apparatus disclosed in Japanese Laid-Open Patent Publication No. 2002-332921 a control is performed to promote the purge operation for reducing the quantity of fuel vapor adsorbed by the canister if the concentration of fuel vapor in the purge passage is relatively high while the quantity of fuel vapor adsorbed by the canister is relatively large. However, in the case of this control, because it cannot specify the time when the refueling operation is performed, the fuel vapor is not necessarily desorbed enough from the canister and purged to the engine to an extent that the canister can adequately adsorb fuel vapor produced in the fuel tank when the refueling operation is performed.

In view of the challenges discussed above, there is a need in the art for a technique of enabling a canister to adequately adsorb fuel vapor produced in a fuel tank when a refueling operation is performed.

SUMMARY

A fuel vapor processing apparatus in accordance with an embodiment may be used for an engine system that may include an engine and a fuel tank. The fuel vapor processing apparatus may include a canister capable of adsorbing fuel vapor produced in the fuel tank, and a purge device that may cause fuel vapor to be desorbed from the canister and to be purged to the engine. The purge device may include a purge control device. The purge device may obtain a target purge quantity to be desorbed from the canister at a point of time during an operation of the engine. In addition, the purge device may control a purge quantity during the operation of the engine such that the purge quantity reaches the target purge quantity.

With this arrangement, the fuel vapor may be desorbed from the canister and purged to the engine until the purge quantity reaches the target purge quantity during the operation of the engine. Therefore, the canister can adequately adsorb fuel vapor produced in the fuel tank when a refueling operation is performed.

The purge control device may include a first calculating device serving as an accumulated fuel consumption quantity calculating device, a second calculating device serving as an accumulated purge quantity calculating device, and a purge quantity control device. The accumulated fuel consumption quantity calculating device may obtain a first value that may be an accumulated fuel consumption quantity of the engine or a value representing the accumulated fuel consumption quantity. The accumulated fuel consumption quantity may be a fuel consumption quantity accumulated after a predetermined time during the operation of the engine. The accumulated purge quantity calculating device may obtain a second value that may be an accumulated purge quantity or a value representing the accumulated purge quantity. The accumulated purge quantity may be a purge quantity accumulated after the predetermined time during the operation of the engine. The purge quantity control device may obtain the target purge quantity by calculating a ratio of a filled-up fuel quantity of the fuel tank to a fuel vapor adsorbable capacity of the canister, multiplied with the first value (i.e., the accumulated fuel consumption quantity). The purge quantity control device may then adjust the purge quantity such that second value (i.e., the accumulated purge quantity) becomes equal to the target purge quantity.

The accumulated fuel consumption quantity may be obtained, for example, by accumulating the fuel consumption at the engine, which may be the fuel quantity injected by the fuel injectors during the operation of the engine. Alternatively, the accumulated fuel consumption quantity may be calculated based on the residual amount of fuel in the fuel tank. Otherwise, it may be possible to use a value corresponding to the accumulated fuel consumption based on accumulation of the rotational speed of the engine, the load applied to the engine, etc. The accumulated purge quantity may be obtained, for example, by accumulating a purge quantity detected by the sensor or the like. Alternatively, the accumulated purge quantity may be obtained, for example, by accumulating a value that may correspond to or represent a purge quantity and may be calculated, for example, based on the concentration of the fuel vapor within the canister. The predetermined time noted above may be a time when the engine is started or when a refueling operation is started.

The purge quantity control device may include a purge quantity increasing device configured to increase the purge quantity. For example, the purge quantity increasing device may be a purge pump for forcibly generating the flow of air (more specifically, a mixture of air and the fuel vapor) from the canister to the engine. Additionally or alternatively, such an increase of the purge quantity may be achieved by lowering an exhaust gas recirculation (EGR) rate, and/or changing the operation time of intake or exhaust valves of the engine, and/or increasing the rotational speed of the engine, and/or operating the engine (in the case of a hybrid vehicle).

The purge control device may be further configured to increase the purge quantity by the purge quantity increasing device when the accumulated purge quantity is smaller than a first reference value. The increase of the purge quantity may be stopped when the accumulated purge quantity is larger than a second reference value that is larger than the first reference value. Each of the first reference value and the second reference value may be determined based on the accumulated fuel consumption quantity.

In one embodiment, the first reference value and the second reference value may be determined according to a graph showing a first characteristic line and a second characteristic line of an accumulated purge quantity with respect to a change of an accumulated fuel consumption quantity. For example, a map showing the graph may be stored in the purge quantity increasing device. The first reference value may be obtained from the first characteristic line, and the second reference value may be obtained from the second characteristic line.

The purge control device may further include a closing valve disposed in a purge passage connecting the fuel tank and the canister. The closing valve may be opened when refueling to the fuel tank.

The purge control device may further include a detection device and a purge correction device. The detection device may detect the flow of fuel vapor from with the fuel tank to the canister during non-refueling to the fuel tank. The purge correction device may correct the target purge quantity such that the target purge quantity is increased.

For example, the detection device may detect the flow of fuel vapor from with the fuel tank to the canister based on a change of an air-fuel ratio of the engine or based on a signal indicating that the closing valve is opened. Alternatively, the detection device may be a lift sensor that can detect a degree of opening of a mechanical relief valve disposed in the purge passage in parallel to the closing valve.

In one embodiment, the purge correction device may increase the target purge quantity by a value that is in proportion to an amount of flow of the fuel vapor detected by the detection device.

DETAILED DESCRIPTION OF EXEMPLARY EMBODIMENTS

Figure 1:
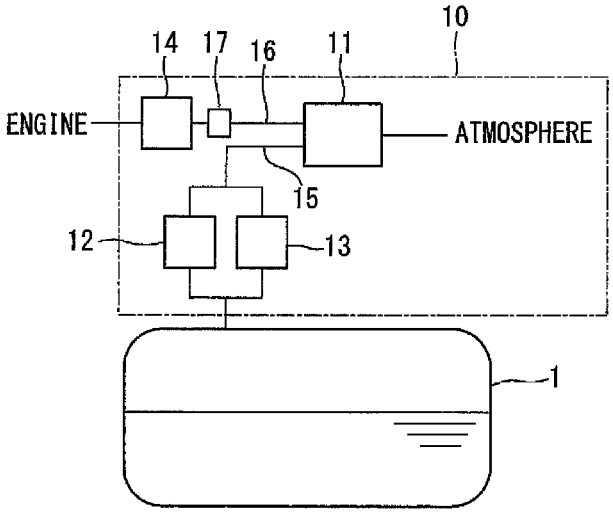
FIG. 1 is a schematic view of an engine system incorporating a fuel vapor processing apparatus in accordance with a first embodiment.

A fuel vapor processing apparatus according to a first embodiment will now be described with reference to FIGS. 1 to 4. FIG. 1 illustrates a fuel vapor processing apparatus 10 incorporated into a vehicle engine system according to a first embodiment. As shown in FIG. 1, the fuel vapor processing apparatus 10 may include a canister 11. The canister 11 may be in fluid communication with a gaseous space formed in a fuel tank 1, via a vapor passage 15. A mechanical relief valve 13 and a solenoid valve or an electromagnetic valve 12 may be disposed in the vapor passage 15 in parallel to each other. An engine control circuit 21 (see FIG. 2) that will be described later may control the electromagnetic valve 12 such that the electromagnetic valve 12 opens when the fuel tank 1 is refueled. The electromagnetic valve 12 may be closed when no refueling operation is performed and may be also called as a closing valve. The mechanical relief valve 13 may be automatically operated in response to the pressure within the fuel tank 1. In detail, the mechanical relief valve 13 may be opened when the pressure within the fuel tank 1 exceeds a predetermined relatively high pressure and when the pressure within the fuel tank 1 falls below a predetermined relatively low pressure. The mechanical relief valve 13 may be closed when the pressure within the fuel tank 1 is between the predetermined relatively high pressure and the predetermined relatively low pressure. In this way, the fuel tank 1 may be prevented from being accidentally damaged by an excessive high pressure and an excessive low pressure within the fuel tank 1. Therefore, during the refueling operation, fuel vapor produced within the fuel tank 1 may flow into the canister 11 so as to be adsorbed by the canister 11. When no refueling operation is performed, the produced fuel vapor may not flow into the canister 11 as long as the mechanical relief valve 13 is not opened. The canister 11 may contain an adsorbent (not shown) that can adsorb fuel vapor. The canister 11 may be connected to an intake pipe of an engine via a purge passage 15, so that the canister 11 may be in fluid communication with an intake air passage defined in the intake pipe. A purge pump 14 and a purge valve 17 may be disposed in the purge passage 16 so as to be connected in series with each other. The purge pump 14 may serve as a purge quantity increasing device as will be described later. The purge pump 14 may operate under the control of the control circuit 21 for producing a flow of gas (a mixture of air and fuel vapor) through the purge passage 16. Therefore, an operation for desorbing fuel vapor from the canister 11 and purging the desorbed fuel vapor to the intake air passage of the engine (hereinafter referred to as "a purge operation") may be promoted. The purge valve 17 may be opened when the purge pump 14 is operated (activated) for purging the fuel vapor to the engine via the purge passage 16.

Figure 2:
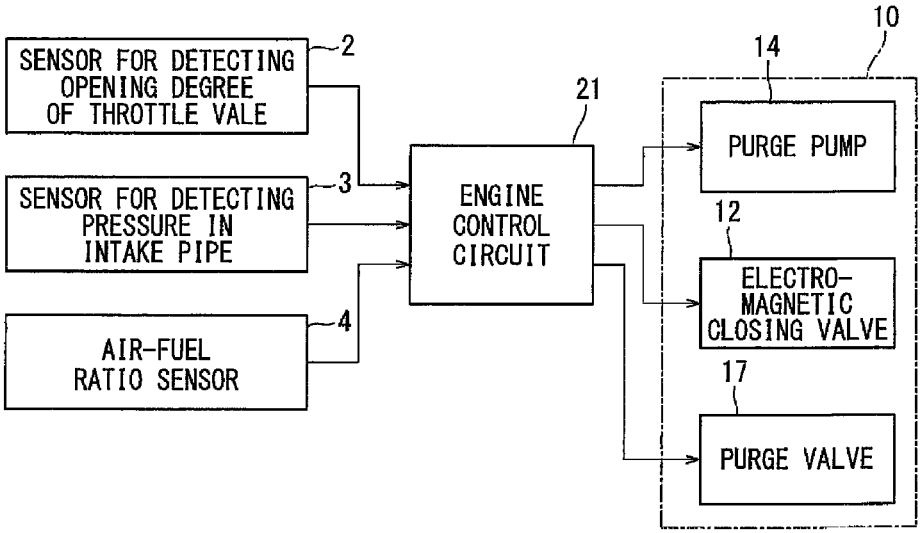
FIG. 2 is a block diagram of a control circuit of the fuel vapor processing apparatus.

Referring to FIG. 2, there is shown the control circuit 21 that may control the operation of the engine system including the operation of the fuel vapor processing apparatus 10. In detail, the control circuit 21 may control the operation of fuel injectors that may inject fuel into the engine, and the timing of the ignition of the spark plugs. The control circuit 21 may perform any other controls relating to the operation of the engine. In addition, the control circuit 21 may control the operations of the purge pump 14, the purge valve 17 and the electromagnetic valve 12. In this connection, a throttle sensor 2 for detecting the degree of opening of a throttle valve (not shown) disposed in the intake air passage, a pressure sensor 3 for detecting the pressure within the intake air passage, and an air-fuel ratio sensor 4 for detecting an air-fuel ratio of a fuel mixture supplied to the engine may be electrically connected to the control circuit 21 and may output corresponding detection signals to the control circuit 21.

Figure 3:
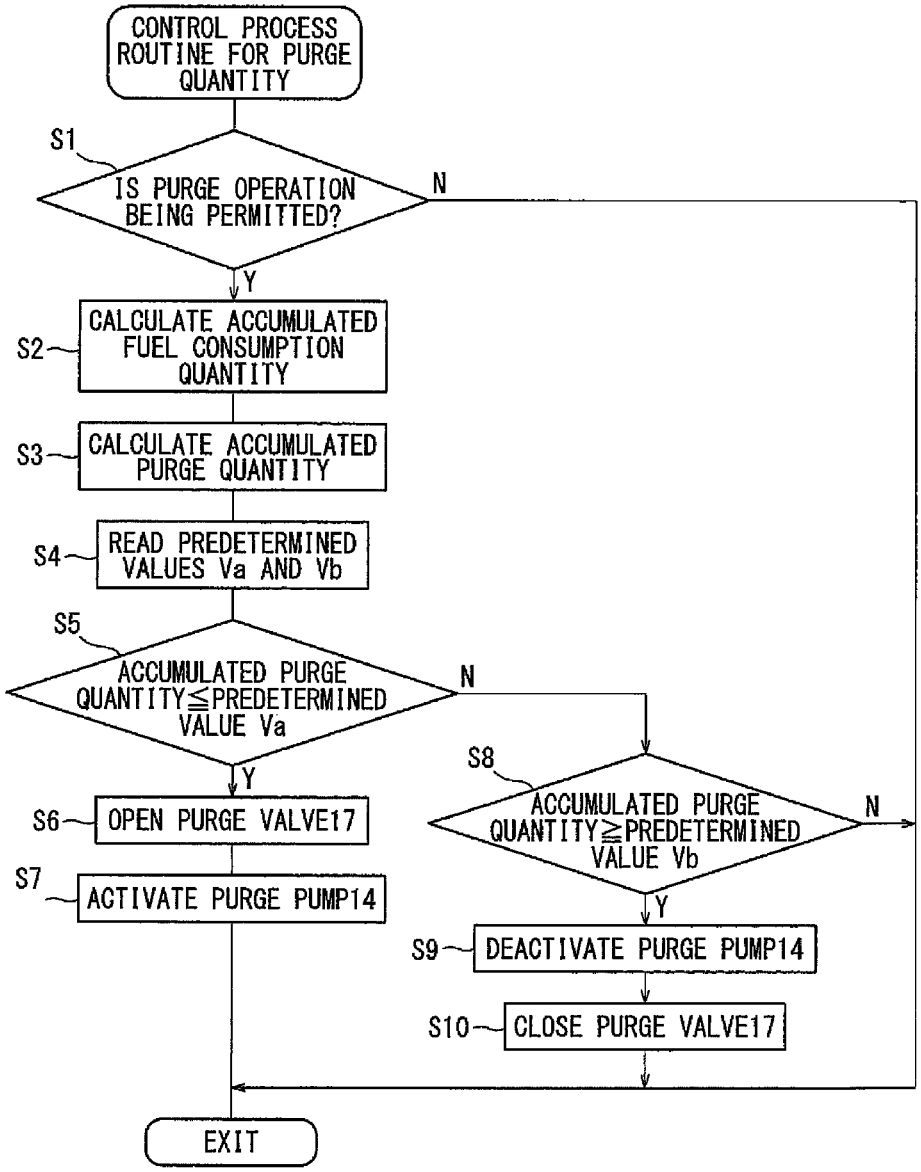
FIG. 3 is a flowchart illustrating a process routine performed by the control circuit for controlling a purge quantity.

The control circuit 21 may include a microcomputer (not shown in the FIGS.) with memory able to store a program for performing various control processes including a purge quantity control process routine shown in FIG. 3. In the process routing shown in FIG. 3, Step S1 may determine whether or not a purge operation is permitted. For example, the microcomputer may perform a feedback control of an air-fuel ratio according to an air-fuel ratio control routine (not shown). Should the feedback control be performed, the microcomputer may determine that the purge control is permitted. Should the determination in Step S1 be "Yes", the process may proceed to Step S2 that may calculate an accumulated fuel consumption quantity. This calculation may be made, for example, with reference to an accumulated value of a quantity of fuel injected by the fuel injectors during the operation of the engine, or based on the residual amount of fuel within the fuel tank 1. Otherwise, the accumulated fuel consumption quantity may be represented by a value that may be an accumulation of the rotational speed of the engine, the load applied to the engine, etc. Then, the process may proceed to Step S3 that may calculate an accumulated purge quantity. The accumulated purge quantity may be an accumulation of the detected purge quantity. Alternatively, the accumulated purge quantity may be represented by a value that may be an accumulation of the concentration of fuel vapor contained in the canister 11 (see FIG. 1). The accumulated fuel consumption quantity calculated at Step S2 and the accumulated purge quantity calculated at Step S3 may be reset at a predetermined time, and the accumulation of these values may be restarted after the predetermined time. For example, the predetermined time may be a time when the engine is restarted, or a time when the refueling operation to the fuel tank 1 is started.

Figure 5:
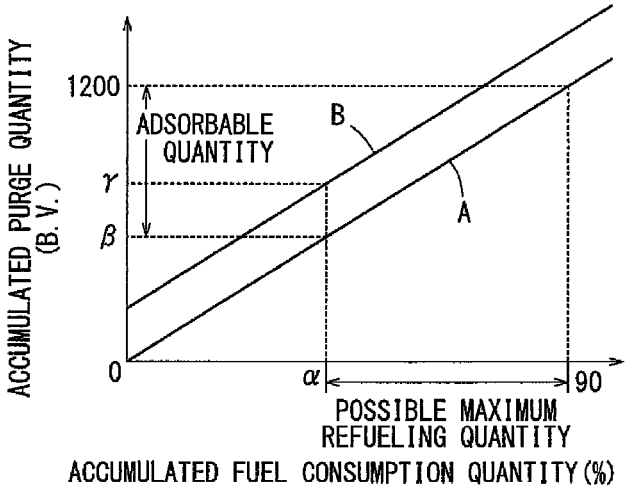
FIG. 5 is a graph illustrating a basic concept of the purge control.

The process may further proceed to Step S4 that may read a predetermined value (quantity) Va and a predetermined value (quantity) Vb each corresponding to the accumulated fuel consumption quantity calculated in Step S2 from a map stored in the memory and shown in FIG. 5. For example, if the accumulated fuel consumption quantity calculated in Step S2 is $\alpha$ %, a value $\beta$ (B.V. (bed volume)) corresponding to the value $\alpha$ on a linear line A is used as the predetermined value Va, and a value $\gamma$ (B.V. (bed volume)) corresponding to the value $\alpha$ in a linear line B is used as the predetermined value Vb.

The map shown in FIG. 5 may be prepared based on a thought that a necessary or adequate capacity (adsorption ability) of the canister 11 is 1200 B.V. for adsorbing entirety of the fuel vapor produced in the fuel tank 1 that is refueled to 90% of its capacity. Here, "1200 B.V." may mean 1,200 times the volume of the canister 11. More specifically, in order that the entirety of the fuel vapor produced during refueling can be adsorbed by the canister 11, the operation of the purge pump 14 may be controlled based on the linear line A that passes through (i) a point where the values of both the accumulated fuel consumption quantity and the accumulated purge quantity are zero and (ii) a point where the accumulated fuel consumption quantity is 90% and the accumulated purge quantity is 1200 B.V. A linear line B may be slightly higher than the linear line A with respect to the accumulated purge quantity and may be used for stopping (deactivating) the purge pump 14. Therefore, at a time after the predetermined time, if the accumulated fuel consumption quantity is $\alpha$ % of a filled-up quantity of the fuel within the fuel tank 1, the purge pump 14 may be operated after the predetermined time for performing the purge operation such that the accumulated purge quantity reaches the value $\beta$. In this way, within a range of a possible maximum refueling quantity necessary for the fuel tank 1 to be filed up with fuel at a time after the predetermined time, a quantity of fuel vapor adsorbable by the canister 11 (hereinafter called "an adsorbable quantity") may conform to a quantity of fuel vapor produced in the fuel tank 1 (hereinafter called "a fuel vapor production quantity"). If the accumulated purge quantity for the accumulated fuel consumption quantity at a time after the predetermined time is lower than a value given by the linear line A, it may be considered that the accumulated purge quantity is not sufficient. Then, the purge pump 14 may be operated to promote the purge operation. On the other hand, if the accumulated purge quantity for the accumulated fuel consumption quantity at a time after the predetermined time is higher than a value given by the linear line B, it may be considered that the accumulated purge quantity is sufficient. Then, the purge pump 14 may be stopped.

The predetermined value Va for the accumulated fuel consumption quantity given by the linear line A as described above may be obtained through calculation. For example, the predetermined value Va may be calculated by [a ratio of the filled-up quantity of the fuel (corresponding to the 90% value of the accumulated fuel consumption quantity) to a maximum capacity of the canister 11 capable of adsorbing fuel vapor (corresponding to 1,200 B.V. of the accumulated purge quantity and hereinafter called "a maximum adsorbable capacity")] multiplied by the accumulated fuel consumption quantity at a time of calculation.

Step S5 in the process routine shown in FIG. 5 may determine whether or not the accumulated purge quantity obtained at Step S3 is equal to or smaller than the predetermined value Va. If the determination in Step S5 is "Yes", this may mean that the accumulated purge quantity is insufficient. Then, the process may proceed to Step S6 that may open the purge valve 17. The process may further proceed to Step S7 that may operate the purge pump 14. These Steps S6 and S7 may promote the purge operation. On the other hand, if the determination in Step S5 is "No", the process may proceed to Step S8 that may determine whether or not the accumulated purge quantity obtained at Step S3 is equal to or larger than the predetermined value Vb. If the determination in Step S8 is "Yes", the process may proceed to Step S9 that may stop the operation of the purge pump 14. Then, the process may further proceed to Step S10 that may close the purge valve 17. These Steps S6 and S7 may stop the purge operation because the accumulated purge quantity is considered to be sufficient. If the determination in Step S8 is "No", the process may skip Steps S9 and S10 to finish the process. Therefore, the purge pump 14 may be still operated or stopped as in the last occasion, and the purge valve 17 may be still in the open position or the closed position as in the last occasion. In this way, by repeatedly performing the processes at Steps S5 to S10, a hysteresis may be set to the operation of the purge pump 14 for starting and stopping the same and also to the operation of the purge valve 17 for opening and closing the same.

Figure 4:
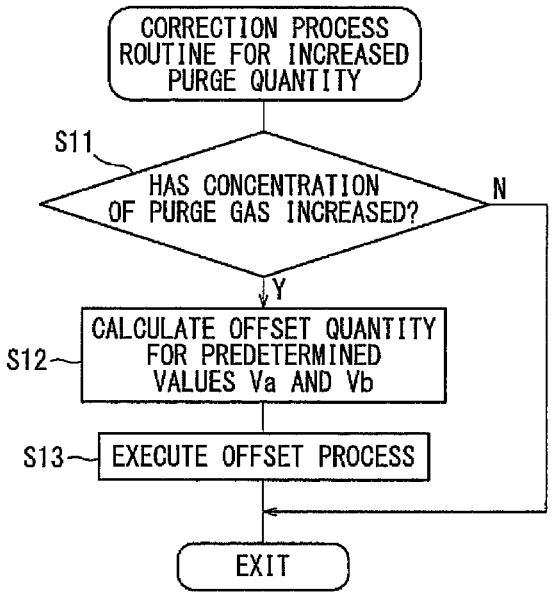
FIG. 4 is a flowchart illustrating a process routine performed by the control circuit for an increase correction of the purge quantity.
Figure 6:
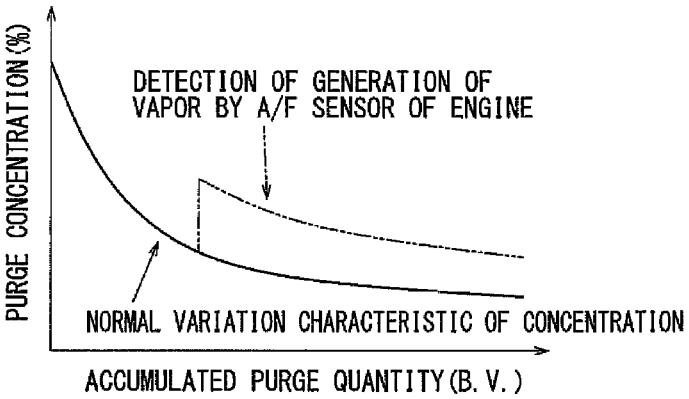
FIG. 6 is a graph illustrating the relationship between a purge concentration and an accumulated purge quantity.

FIG. 4 illustrates a process routine performed by the microcomputer of the control circuit 21 for an increase correction of the purge quantity. This process routine may be performed as an interruption process. More specifically, this process routine may be performed in such an occasion that the fuel vapor flows from within the fuel tank 1 to the canister 11 when no refueling operation is performed. Step S11 may determine whether or not a purge concentration is increased during the operation of the engine. Here, the term "purge concentration" is used to mean a concentration of fuel vapor contained in a purge gas (i.e., a mixture of air and fuel vapor) supplied to the engine. The purge concentration may be calculated based on the air-fuel ratio of the engine detected by the air-fuel ratio sensor 4 and a fuel injection quantity injected into the engine by the fuel injectors. Alternatively, the purge concentration may be directly detected by a purge concentration sensor (not shown) that may be attached to the intake pipe of the engine. FIG. 6 shows a characteristic line (solid line) illustrating a change of the purge concentration with respect to a change of the accumulated purge quantity during a normal operation. If the purge concentration has increased to exceed a predetermined value (i.e., a value on the characteristic line in FIG. 6) continuously over a predetermined period of time as indicated by chain lines in FIG. 6, the microcomputer may determine that the fuel vapor has flown from within the fuel tank 1 to the canister 11 during the non-refueling operation. Therefore, the determination at Step S11 may be "Yes", so that the process may proceed to Step S12. For example, the flow of fuel vapor from within the fuel tank 1 to the canister 11 during the non-refueling operation may occur when the mechanical relief valve 13 is opened to prevent potential damage to the fuel tank 1 in the case that the pressure within the fuel tank has excessively increased or decreased. The flow of fuel vapor from within the fuel tank 1 to the canister 11 during the non-refueling operation may also occur when the electromagnetic valve 12 is opened to release the pressure within the fuel tank 1 to approach the atmospheric pressure prior to the refueling operation.

Figure 7:
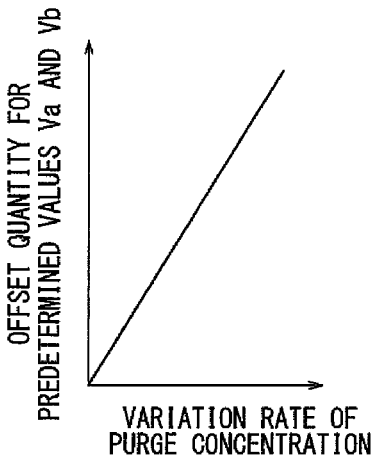
FIG. 7 is a graph illustrating the purge increase correction control.

Should the determination at Step S11 be "Yes", the process may proceed to Step S12 that may calculate an offset value for the predetermined values Va and an Vb for increasing the accumulated purge quantity in response to the increase of the quantity of fuel vapor adsorbed by the canister 11. The calculation of the offset value may be performed, for example, with reference to a graph shown in FIG. 7, so that the offset value may increase in proportion to the increase of the purge concentration. Then, the process may proceed to Step S13 that may add the calculated offset value to the predetermined values Va and Vb. Therefore, the operational range of the purge pump 14 may increase by a range corresponding to the offset value. As a result, the purge operation may be promoted.

According to the first embodiment, a target purge quantity that may be necessary or adequate at a point of time of the purge control may be obtained based on the accumulated fuel consumption quantity at that point of time, and the purge pump 14 may be operated such that the accumulated purge quantity approaches the target purge quantity. In this way, the fuel vapor may be purged from the canister 11 to such an extent that the canister 11 can adequately adsorb the fuel vapor produced during the refueling operation. Further, the purge pump 14 may be operated when needed, and it may not be operated when there is no need. Therefore, it may be possible to avoid unnecessary energy consumption and to improve the fuel economy.

Further, according to the first embodiment, the electromagnetic valve 12 may be disposed in the vapor passage 15, so that the flow of fuel vapor from within the fuel tank 1 to the canister 11 occurs only when the electromagnetic valve 12 is opened in response to the refueling operation. Therefore, the purge control can be accurately performed though the control of the operation of the purge pump 14. Furthermore, the microcomputer may determine if the flow of fuel vapor from within the fuel tank 1 to the canister 11 has occurred during non-refueling. If this flow of fuel vapor during non-refueling occurs, the microcomputer may perform a correction control for increasing the purge quantity. Therefore, even in the event that the fuel vapor flows from within the fuel tank 1 to the canister 11 during non-refueling, the fuel vapor may be purged from the canister 11 to enable the canister 11 to adequately adsorb fuel vapor that may be produced during the refueling operation performed at the next time.

In this way, a corresponding part of the program stored in the memory of the microcomputer for executing Step S2 may serve as a device for calculating the accumulated fuel consumption quantity, a corresponding part of the program for executing Step S3 may serves as a device for calculating the accumulated purge quantity, a corresponding part of the program for executing Steps S4 to S10 may serve as a purge control device, a corresponding part of the program for executing Step S11 may serve as a detecting device for detecting the flow of fuel vapor into the canister 11, and a corresponding part of the program for executing Steps S12 and S13 may serve as a purge correction device for increase the purge quantity.

Figure 8:
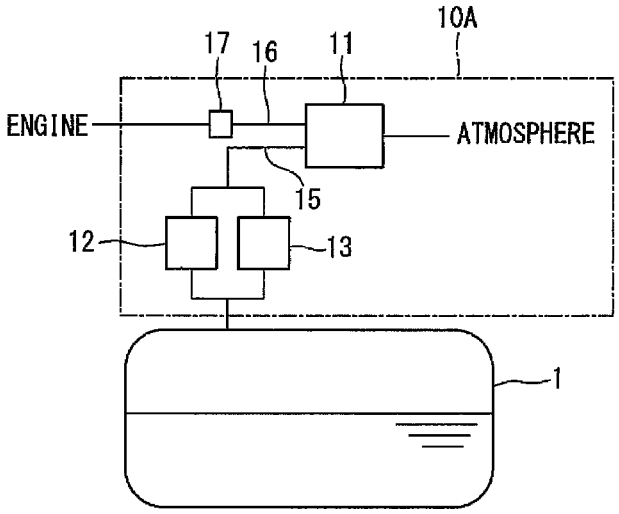
FIG. 8 is a schematic view of an engine system incorporating a fuel vapor processing apparatus in accordance with a second embodiment.

A second embodiment will now be described with reference to FIG. 8. The second embodiment is a modification of the first embodiment. Therefore, in FIG. 8, like members are labeled with the same reference numerals as the first embodiment, and a redundant description of the same will be omitted. A fuel vapor processing apparatus 10A shown in FIG. 8 may be different from the fuel vapor processing apparatus 10 shown in FIG. 1 of the first embodiment in that no purge pump is disposed in the purge passage 16.

According to the second embodiment, the operation for purging (desorbing) fuel vapor from the canister 11 may be performed by using a negative pressure that may be produced in the intake air passage during the operation of the engine. In addition, the increase of the purge quantity may be achieved by controlling the operation of the engine during the opening of the purge valve 17. For example, such an increase of the purge quantity may be achieved by lowering an exhaust gas recirculation (EGR) rate, and/or by changing the operation time of intake or exhaust valves of the engine, and/or by increasing the rotational speed of the engine, and/or by operating the engine (in the case of a hybrid vehicle). Therefore, in the case of the second embodiment, Steps S7 and S9 for operating and stopping the purge pump 14 may be replaced with the operations for increasing the negative pressure by controlling the operation of the engine and for stopping the operations for increasing the negative pressure.

The various examples described above in detail with reference to the attached drawings are intended to be representative and thus not limiting. The detailed description is intended to teach a person of skill in the art to make, use and/or practice various aspects of the present teachings and thus is not intended to limit the scope of the invention. Furthermore, each of the additional features and teachings disclosed above may be applied and/or used separately or with other features and teachings to provide improved fuel vapor processing apparatus, and/or methods of making and using the same.

Moreover, the various combinations of features and steps disclosed in the above detailed description may not be necessary to practice the invention in the broadest sense, and are instead taught to describe representative examples. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel vapor processing apparatus for an engine system including an engine and a fuel tank, the fuel vapor processing apparatus comprising:

a canister configured to adsorb fuel vapor produced in the fuel tank;

a purge device comprising a purge valve, the purge device being configured to desorb fuel vapor from the canister and to purge the desorbed fuel vapor to the engine;

wherein the purge device further comprises a purge control device that includes a microcomputer, the purge control device being configured to:

obtain a target purge quantity to be desorbed from the canister at a point of time during an operation of the engine;

control a purge quantity during the operation of the engine such that the purge quantity reaches the target purge quantity;

obtain a first value that is an accumulated fuel consumption quantity of the engine or a value representing the accumulated fuel consumption quantity, the accumulated fuel consumption quantity being a fuel consumption quantity accumulated after a predetermined time during the operation of the engine; and obtain a second value that is an accumulated purge quantity or a value representing the accumulated purge quantity, the accumulated purge quantity being a purge quantity accumulated after the predetermined time during the operation of the engine;

wherein the purge control device further comprises a purge quantity control device that includes a microcomputer, the purge quantity control device being configured to:

obtain the target purge quantity by calculating a ratio of a filled-up fuel quantity of the fuel tank to a fuel vapor adsorbable capacity of the canister, multiplied with the first value; and adjust the purge quantity such that the second value becomes equal to the target purge quantity.

2. The fuel vapor processing apparatus according to claim 1, wherein the purge quantity control device comprises a purge quantity increasing device configured to increase the purge quantity.

3. The fuel vapor processing apparatus according to claim 2, wherein the purge control device is further configured to:

increase the purge quantity by the purge quantity increasing device when the second value is smaller than a first reference value; and stop an increase of the purge quantity when the second value is larger than a second reference value, wherein the second reference value is larger than the first reference value;

wherein each of the first reference value and the second reference value is determined based on the first value.

4. The fuel vapor processing apparatus according to claim 3, wherein:

the first reference value and the second reference value are determined according to a graph showing a first characteristic line and a second characteristic line of the accumulated purge quantity with respect to a change of the accumulated fuel consumption quantity;

the first reference value is obtained from the first characteristic line; and the second reference value is obtained from the second characteristic line.

5. The fuel vapor processing apparatus according to claim 1, wherein:

the purge control device further comprises a closing valve disposed in a purge passage connecting the fuel tank and the canister, and the purge control device is further configured to open the closing valve during refueling of the fuel tank.

6. A fuel vapor processing apparatus for an engine system including an engine and a fuel tank, the fuel vapor processing apparatus comprising:

a canister configured to adsorb fuel vapor produced in the fuel tank;

a purge device comprising a purge valve, the purge device being configured to desorb fuel vapor from the canister and to purge the desorbed fuel vapor to the engine;

wherein the purge device further comprises a purge control device that includes a microcomputer, the purge control device being configured to:

obtain a target purge quantity to be desorbed from the canister at a point of time during an operation of the engine; and control a purge quantity during the operation of the engine such that the purge quantity reaches the target purge quantity;

wherein the purge control device further comprises:

a detection device configured to detect flow of fuel vapor from the fuel tank to the canister during non-refueling to the fuel tank; and a purge correction device comprising a microcomputer configured to correct the target purge quantity such that the target purge quantity is increased when the detection device detects the flow of fuel vapor.

7. The fuel vapor processing apparatus according to claim 6, wherein the purge correction device is further configured to increase the target purge quantity by a value that is in proportion to an amount of flow of the fuel vapor detected by the detection device.

8. A fuel vapor processing apparatus for an engine system including an engine and a fuel tank, the fuel vapor processing apparatus comprising:

a canister configured to adsorb fuel vapor produced in the fuel tank; and a purge device comprising a purge pump and a purge valve configured to desorb fuel vapor from the canister and to purge the desorbed fuel vapor to the engine during the operation of the engine and during non-refueling to the fuel tank until a quantity of fuel vapor capable of being adsorbed by the canister reaches a target quantity that corresponds with a free capacity of the canister to adsorb the fuel vapor produced if the fuel tank were filled up.

9. The fuel vapor processing apparatus according to claim 8, wherein:

the quantity of fuel vapor capable of being adsorbed by the canister is determined by a first value that is an accumulated purge quantity or a value representing the accumulated purge quantity, the accumulated purge quantity being an accumulation from a predetermined time of a quantity of the desorbed fuel vapor; and the target quantity is determined based on the first value with reference to a second value that is an accumulated fuel consumption quantity or a value representing the accumulated fuel consumption quantity, the accumulated fuel consumption quantity being an accumulation from the predetermined time of a quantity of fuel consumed at the engine.

10. The fuel vapor processing apparatus according to claim 8, wherein the purge device is further configured to increase the target quantity if the fuel vapor flows from within the fuel tank to the canister during non-refueling to the fuel tank.

* * * * *